US005496442A

United States Patent [19]

Laapotti

[11] Patent Number: 5,496,442

[45] Date of Patent: Mar. 5, 1996

[54] METHOD AND APPARATUS FOR OPENING A NIP IN AN EXTENDED-NIP PRESS

[75] Inventor: Jorma Laapotti, Palokka, Finland

[73] Assignee: Valmet Paper Machinery Inc., Helsinki, Finland

[21] Appl. No.: 207,296

[22] Filed: Mar. 7, 1994

[30] Foreign Application Priority Data

Mar. 24, 1993 [FI] Finland ..... 931321

[51] Int. Cl.[6] ..... D21F 3/02

[52] U.S. Cl. ..... 162/199; 162/272; 162/358.3; 162/358.5

[58] Field of Search ..... 162/358.3, 358.4, 162/358.5, 361, 205, 199, 272

[56] References Cited

U.S. PATENT DOCUMENTS

| | | | |
|---|---|---|---|
| 4,707,222 | 11/1987 | Mullner et al. | 162/358.3 |
| 4,856,154 | 8/1989 | Nikulainen et al. | 422/6 |
| 4,909,903 | 3/1990 | Mullner | 162/358.3 |
| 4,919,761 | 4/1990 | Schiel et al. | 162/358.3 |
| 5,084,137 | 1/1992 | Ilmarinen et al. | 162/358.3 |
| 5,098,523 | 3/1992 | Ilmarinen et al. | 162/358.3 |
| 5,223,100 | 6/1993 | Schiel et al. | 162/358.3 |

FOREIGN PATENT DOCUMENTS

| | | | |
|---|---|---|---|
| 894448 | 3/1990 | Finland . | |
| 921299 | 10/1992 | Finland . | |
| 84740 | 2/1993 | Finland . | |
| 3317457 | 11/1984 | Germany | 162/358.3 |
| 3735492 | 5/1988 | Germany . | |
| 2182367 | 5/1987 | United Kingdom . | |
| 2223082 | 3/1990 | United Kingdom . | |

*Primary Examiner*—Karen M. Hastings
*Attorney, Agent, or Firm*—Steinberg, Raskin & Davidson

[57] ABSTRACT

A method and apparatus for opening a nip in an extended-nip press in which a nip is formed by a pair of rolls. A loading shoe of the loading members of an extended-nip press roll in the nip is shifted to an open position and apart from the glide-belt mantle when the nip is opened. An inner end-flange part of the end flange is operatively coupled with bearing means of a glide-belt mantle and is rotated in a direction parallel to the face of a central axle of the extended-nip press roll, whereby the glide-belt mantle is removed from contact with a back-up roll since a central axis of the end-flange part is located at a distance from a central axis of the extended-nip press roll.

19 Claims, 4 Drawing Sheets

METHOD AND APPARATUS FOR OPENING A NIP IN AN EXTENDED-NIP PRESS

BACKGROUND OF THE INVENTION

The present invention relates to a method for opening a nip in an extended-nip press and an apparatus for opening a nip in an extended-nip press.

In an extended-nip press, formed in part by a back-up roll, the back-up roll is usually heated and a press felt and glide-belt mantle which run through the extended nip may be damaged if the press machine has to be stopped from some reason because of a disturbance in the running of the web through the paper machine. For example, when the temperature of the water in a hot-water heated back-up roll is about 140° C. and the surface temperature of the back-up roll is about 80° C. during running of the press machine, after stopping the press machine, the surface temperature of the outer surface of the back-up roll rises to about 120° C. At this high temperature, it is drawback that prolonged exposure of the press felt and glide-belt mantle in the vicinity of the heated surface of the back-up roll may damage the press felt and glide-belt mantle.

Another drawback of existing extended-nip presses is that since the compression of the back-up roll against the closed glide-belt mantle is generally from about 20 mm to about 35 mm, contact between the glide-belt mantle and the back-up roll cannot be removed even if the glide shoe is pulled into the open position. It is also not possible to displace the back-up roll and the extended-nip roll rapidly into an open position in relation to one another, because, owing to the very high maximal load, the press force is transferred through draw bars or through the frame skeleton.

OBJECTS AND SUMMARY OF THE INVENTION

Accordingly, it is an object of the present invention to provide a new and improved method and apparatus for opening a nip, and especially an extended nip, formed in part by a roll having a glide-belt mantle passing over it so that the belt mantle can be removed from the nip, out of the proximity of a back-up roll when the press machine is not running.

It is another object of the present invention to provide a new and improved method and apparatus for opening a nip in a press machine, when the press machine has stopped operating, in which drawbacks of prior art solutions are substantially eliminated.

In order to achieve these objects, and others, in the present invention, a method and apparatus for opening a nip are described in which an eccentric end of a press roll in an extended-nip is rotated after an opening movement of the press shoe so that the belt mantle is shifted apart from the back-up roll.

In order to avoid thermal damage to the press felt, the guide rolls of the felt loop may also be displaced so that the press felt is removed from contact with a hot roll, e.g., heated back-up roll, out of the nip.

In addition, the method and apparatus for opening a nip that are employed herein facilitate replacements of press felts and glide-belt mantles and make the replacements quicker.

In the method in accordance with the present invention, when an extended nip formed between a pair of rolls is opened, a loading shoe acted upon by loading members in one of the rolls in the extended-nip is shifted to an open position and apart from the glide-belt mantle. This can be achieved by removing the loading force loading the shoe. An inside end-flange part of an end flange of the roll is operatively coupled with bearing means of the glide-belt mantle and is rotated in a direction parallel to the face of a central axle of the roll. In this manner, the glide-belt mantle is separated from contact with the back-up roll in view of the fact that the central axis of the end-flange part is placed at a distance from the central axis of the roll, i.e., is provided with a slight eccentricity.

In the apparatus in accordance with the invention, a closed resilient glide-belt mantle of the extended-nip press roll is attached at its edges to an outside end-flange part of the end flange. The outside end-flange part is further arranged to revolve on support of bearing means which are placed between the outside end-flange part and an inner end-flange part. The inner end-flange part is arranged so that its central axis is placed eccentrically in relation to the central axis of the axle of the extended-nip press roll. By means of this arrangement, by rotating the inner end-flange part, the eccentricity of the inner end-flange part is utilized so that the glide-belt mantle can be shifted into different positions in relation to the back-up roll, e.g., apart from the back-up roll (to open the nip) or into proximity with the back-up roll (to close the nip for use).

The extended-nip press utilizing the method and apparatus in accordance with the invention, comprises an extended nip through which a paper or board web runs. In connection with a lower one of the pair of rolls forming the nip, i.e., the extended-nip press roll, the apparatus comprises a press member which is pressed by force against the back-up roll. The back-up roll is preferably heated but may also be a non-heated press roll. The displaceable press member is preferably a press shoe which is pressed by loading-cylinder means against the heated back-up roll. The apparatus further comprises an endless felt which is passed through the press zone and which receives water. The press felt is arranged to run through a press zone in the extended nip together with a fibrous web to be dewatered. A closed glide-belt mantle of the extended-nip roll passes through the press zone so that the web is passed through the nip area between the felt and the back-up roll. The extended-nip may also comprise two felts running therethrough, between which the web is carried and pressed.

In an arrangement in a paper machine utilizing the apparatus and method for opening a nip in accordance with the present invention, a back-up roll and a press roll arranged adjacent thereto form a press nip. The press roll has a central axle having a central axis and an end flange comprising an outer end-flange part and an inner end-flange part. The end flange member has a central axis arranged eccentric with respect to the central axis of the central axle of the press roll. Loading members are connected to the central axle of the press roll and press a loading or glide shoe in a direction toward the back-up roll to provide a compression pressure in the nip which dewaters the web. A glide-belt mantle is attached to the outer end-flange part. Bearing means are situated between the inner end-flange part and the outer end-flange part and permit rotation of the inner end-flange part relative to the outer end-flange part. The arrangement further comprises means for rotating the inner end-flange part to utilize the eccentricity of the end flange, and the inner end-flange part, and move the glide-belt mantle relative to the back-up roll, e.g., out of the nip when opening the nip or into the position in relation to the back-up roll to form the nip.

In a preferred embodiment, the arrangement includes a felt which carries a web through the nip, and displacement means for moving the felt away from the back-up roll when the nip is being opened. The displacement means comprise displaceable felt-guide rolls arranged on both sides of the nip, a displaceable blow-box, and actuators coupled to the felt-guide rolls and the blow box. The actuators move the felt-guide rolls and the blow-box into position in which the felt is moved away from the back-up roll.

The present invention will be described in the following with reference to preferred embodiments of the invention, which are illustrated in the figures in the accompanying drawings. However, the present invention is not confined to these embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
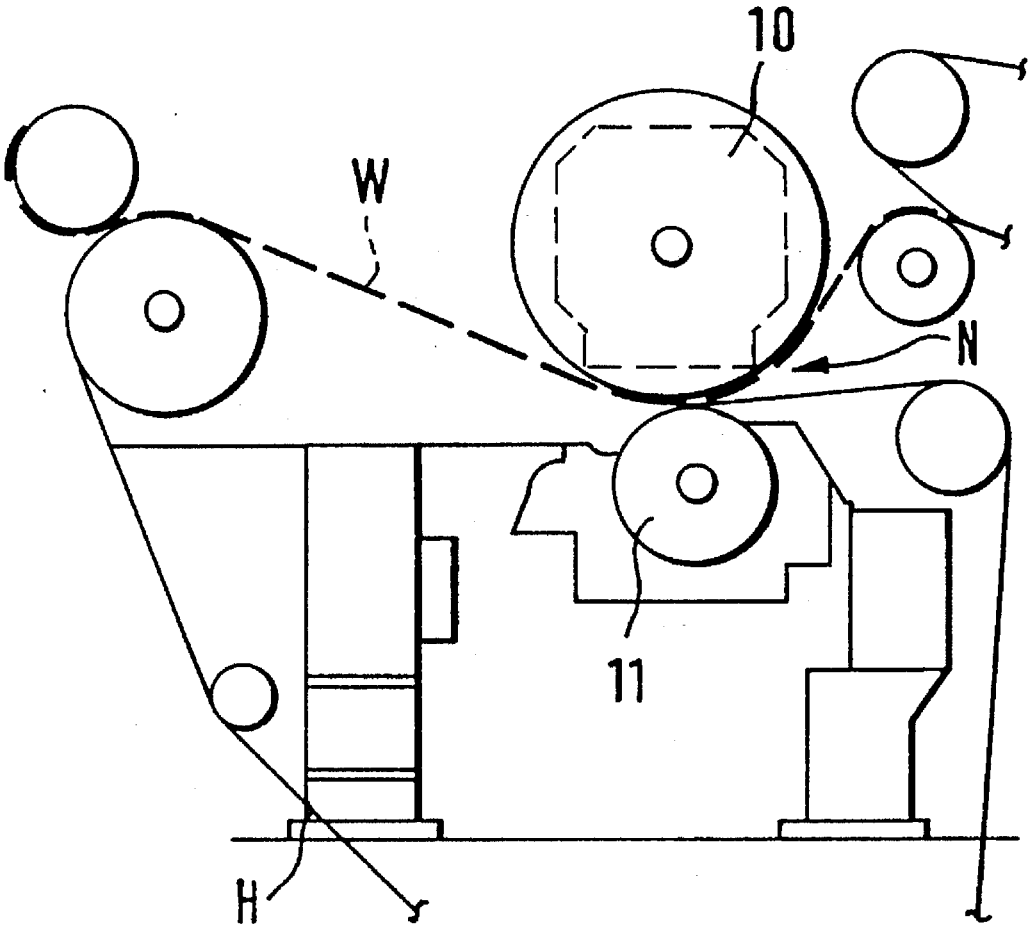
FIG. 1 shows an extended-nip press arrangement of a paper machine in which the method and apparatus of the present invention are applied.

Referring to the accompanying drawings in which like reference numerals refer to the same element, FIG. 1 shows an extended-nip press in a paper machine in which a web W is passed into a nip N formed between a lower extended-nip press roll 11 and a heated back-up roll 10. The web W is carried on a felt H running over the press roll 11 into contact with a roll face 10' of the back-up roll 10.

Figure 2:
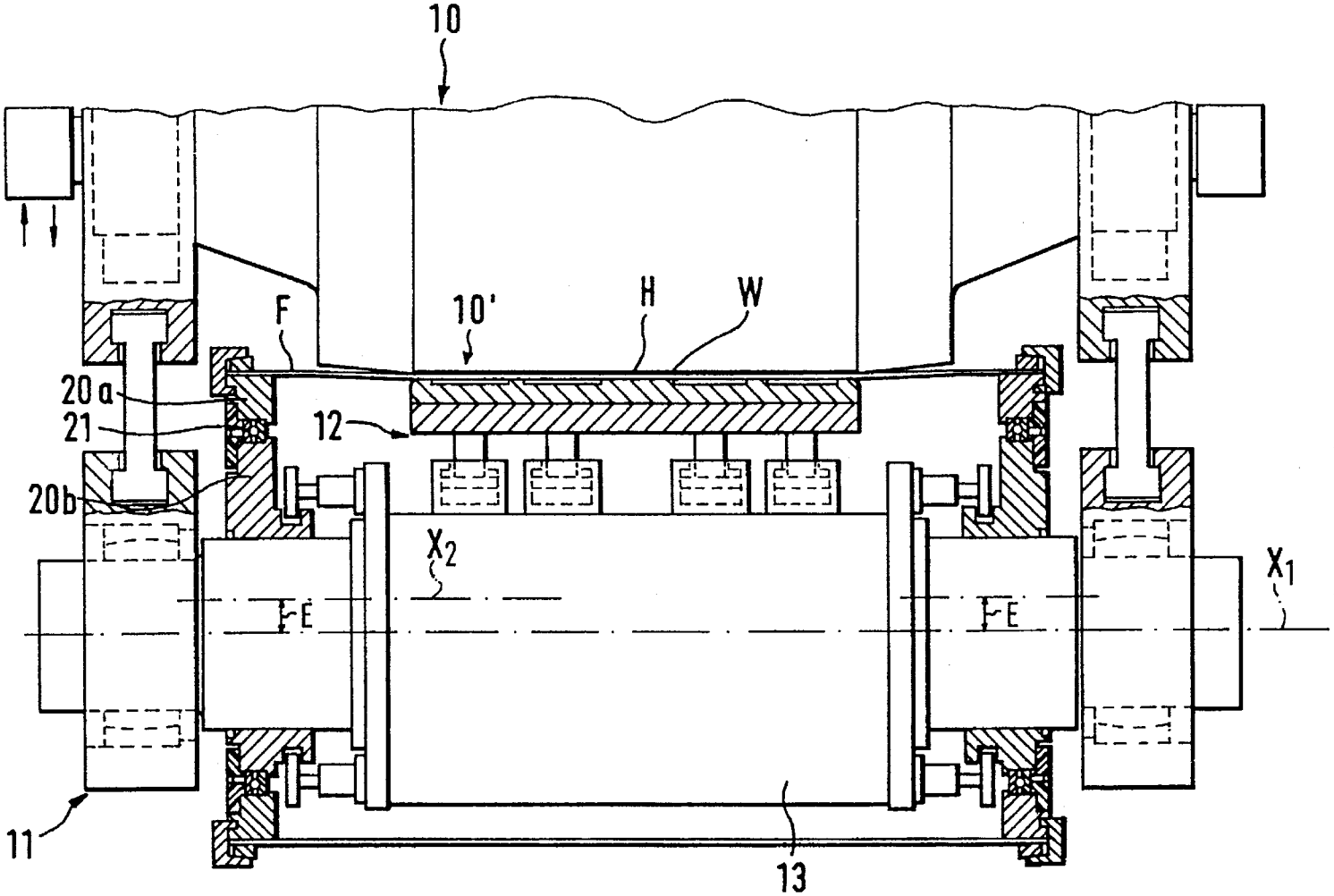
FIG. 2 shows an assembly of the apparatus in accordance with the present invention viewed in the machine direction.

FIG. 2 shows the rolls 10 and 11 of FIG. 1 as viewed in the machine direction. The extended nip formed between the rolls 10 and 11 is denoted by reference arrow N. The felt H and the web W are passed through the nip N. The roll 10 is preferably a heated back-up roll, and the roll 11 is an extended-nip roll comprising loading means $12a_1$, $12a_2$,... The loading means $12a_1$, $12a_2$... are preferably cylinder means arranged in conjunction with a central axle 13 of the roll 11 and operating with a force applied to a loading or glide shoe **12*b***. The force is further transmitted through a flexible closed glide-belt mantle F to the web W to dewater the web. In the present invention, the web W is understood as referring to a paper or board web.

The lower extended-nip press roll 11 comprises the flexible closed glide-belt mantle F, which is arranged to run along a face of the loading shoe or glide shoe **12*b*, i.e., to conform to the shape of the back-up roll which is usually the corresponding shape of the loading shoe. An oil medium is passed into a space between the glide shoe 12*b* and the closed glide-belt mantle F as a lubricating medium. The back-up roll 10 is preferably a roll that is heated by means of, e.g., an internal heating medium, such as water, steam or oil, or externally, e.g., by means of induction or infrared radiation. The back-up roll 10** may also be a non-heated roll.

Figure 3:
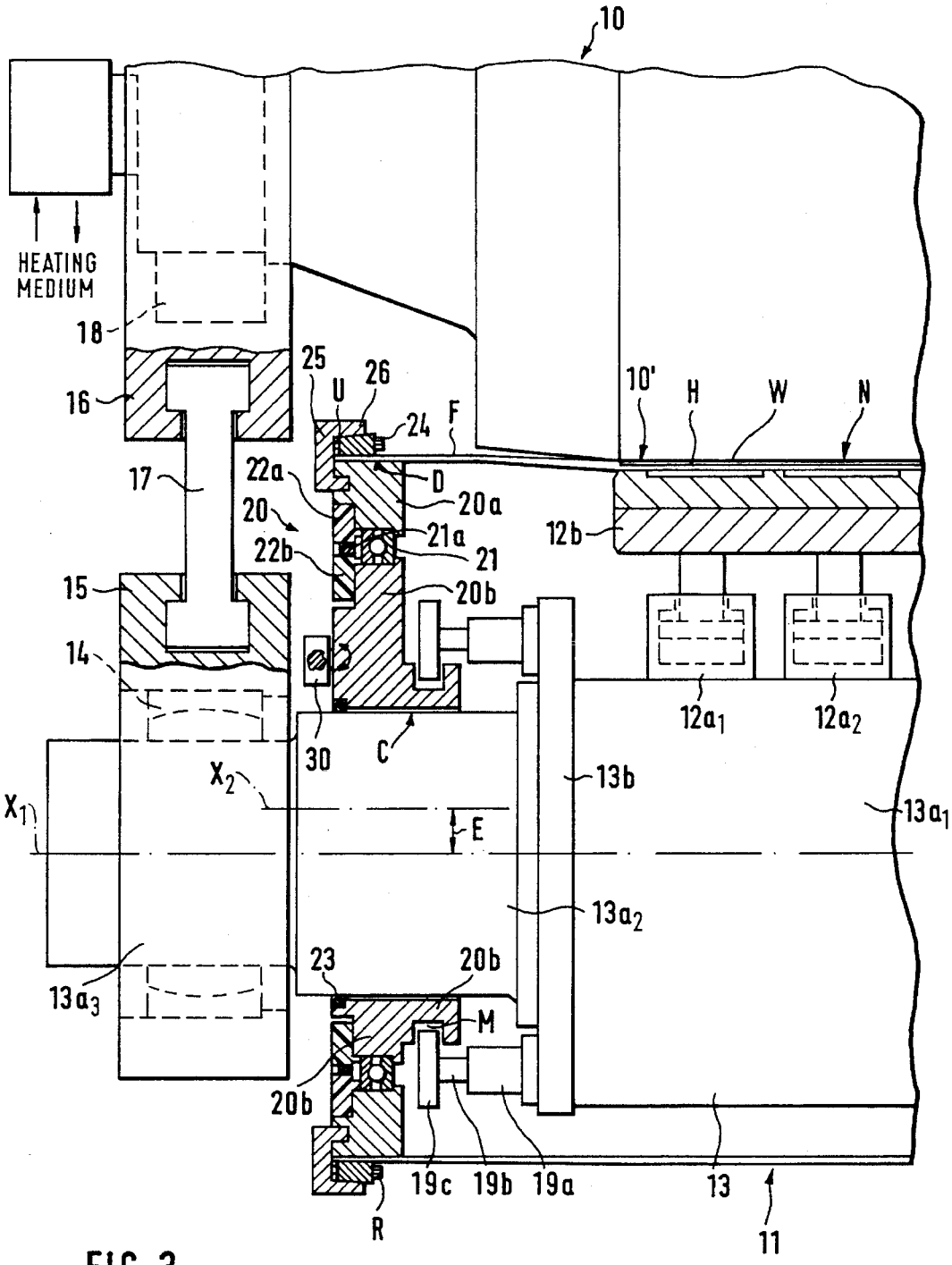
FIG. 3 shows an end area of the roll assembly in accordance with the present invention as shown in FIG. 2.

FIG. 3 shows an enlarged view of one side of the rolls 10,11. As shown in FIG. 3, the equipment comprises a heated back-up roll 10 and an extended-nip press roll 11 jointly operative with the back-up roll. The paper web W, the felt H, and the glide-belt mantle F of the roll 11 are passed through the nip N between the rolls 10,11.

The extended-nip press roll 11 comprises loading means 12, which consist of actuators $12a_1$, $12a_2$...$12a_n$, preferably hydraulic cylinders, by whose means the glide shoe **12*b* is acted upon with a force such that the glide shoe 12*b* is pressed against the back-up roll 10. This causes the web W to be subjected to compression pressure between the felt H and the face 10' of the back-up roll 10**.

The extended-nip press roll 11 comprises a stationary nonrevolving central axle 13, which comprises a central-axle portion $13a_1$ in the middle part of the roll and lateral axle portions $13a_2$ and $13a_1$ having a smaller diameter. A flange **13*b* is arranged between the axle portions $13a_1$ and $13a_2$. The extended-nip press roll 11 is suspended, by means of its central axle 13, on bearing means 14 situated at ends of the axle, which permit a certain deflection and angular change for the axle 13 in a loading situation. A bearing housing 15 of the bearing means 14, or related constructions, are coupled with a bearing housing 16 of bearing means 18 of the roll 10, or with a related construction, by means of a tie bar 17 or equivalent coupling structure. The roll 10 is journalled on bearing means 18** so that it revolves.

The flange **13*b* is coupled with one or more actuators 19, which are preferably cylinder devices and comprise a cylinder body 19*a*, a cylinder rod 19*b*, and a roller or a glide piece 19*c* at an end of the actuator. The glide piece 19*c* is arranged to run in a groove M formed in a shoulder 20*b*' of an end flange 20*b* of roll 11. By means of the actuator/actuators 19, the glide-belt mantle F is tensioned by a force applied by the actuators to act upon the end flanges 20. The end flanges are arranged to glide on the axle portions $13a_2$. The actuator construction 19** may be similar at both ends of the roll.

The end flange 20 comprises a first end-flange part **20*a* (also referred to as an outer end-flange part) and a second end-flange part 20*b* (also referred to as an inner end-flange part) which is placed inside the first end-flange part 20*a*. Between the end-flange parts 20*a* and 20*b*, journalling or bearing means 21 and sealing members 21*a* are arranged. The end-flange part 20*b* can be constructed so that it glides on the axle portion $13a_2$ so that rotation of the end-flange part 20*b* in relation to the axle 13 is permitted. The bearing means 21 are arranged between the flange parts 20*a*,20*b*, and they are retained in their positions by means of covers 22*a*,22*b*. During operation and running of the press machine, the glide-belt mantle F is rotated on bearing means 21**.

End flange 20 is arranged to glide on the face C of the axle portion $13a_2$. A seal 23 is arranged at a side edge of the end-flange part **20*b* to glide against the face C. By means of the actuators 19, the glide-belt mantle F is tensioned between the end flanges 20 as described above. The glide-belt mantle F is attached to the end-flange part 20*a* by wedge-ring segments 24 and fastening-ring segments 25 arranged at the outer edge of the end-flange part 20*a*. The wedge-ring segments 24 are arranged in the fastening-ring segments 25 between the shoulder 26 and an outer face D of the end-flange part 20*a*. The glide-belt mantle F is tensioned by its ends against the outer face D of the end-flange part 20*a*** by pressing the wedge-ring segments 24 by means of a screw device R tightly towards the bottom of a fastening groove U. In this manner, by means of the wedge-ring segments 24, a sealing force is applied to the glide-belt mantle F, and the mantle is kept tightly against the outer face D of the end-flange part 20*a*.

As shown in FIG. 3, the axis of rotation of the glide-belt mantle F coincides with the central axis of the outer end-flange part 20*a* of the end flange 20 in accordance with the present invention and is denoted by $X_2$. The central axis of the inner end-flange part 20*b* and the entire end flange 20 coincides with the axis $X_2$. The central axis of the axle 13 of the extended-nip roll 11 is denoted by $X_1$. A distance E between the axes $X_2$ and $X_1$ is the eccentricity of the end-flange part 20*b*. The inner flange part 20*b* of the end flange 20 is rotated around the axis $X_1$.

In accordance with the invention, when opening the nip N, the inner end-flange part 20*b* is rotated by means of an actuator 30 in a direction parallel to the face C of the axle portion $13a_2$ of the axle 13. Owing to the difference in distance between the above axes $X_1$ and $X_2$, i.e., the eccentricity E, the glide-belt mantle F is shifted apart from the heated back-up roll 10. Thus, the actuator rotates the inner end-flange part to utilize the eccentricity of the inner end-flange part and move the glide-belt mantle coupled thereto away from the back-up roll.

The actuator 30 is preferably a hydraulic cylinder having articulated joints both at the end of the cylinder rod and at the end of the cylinder body. FIG. 3 includes a sectional view of the piston rod of the cylinder 30.

Figure 4:
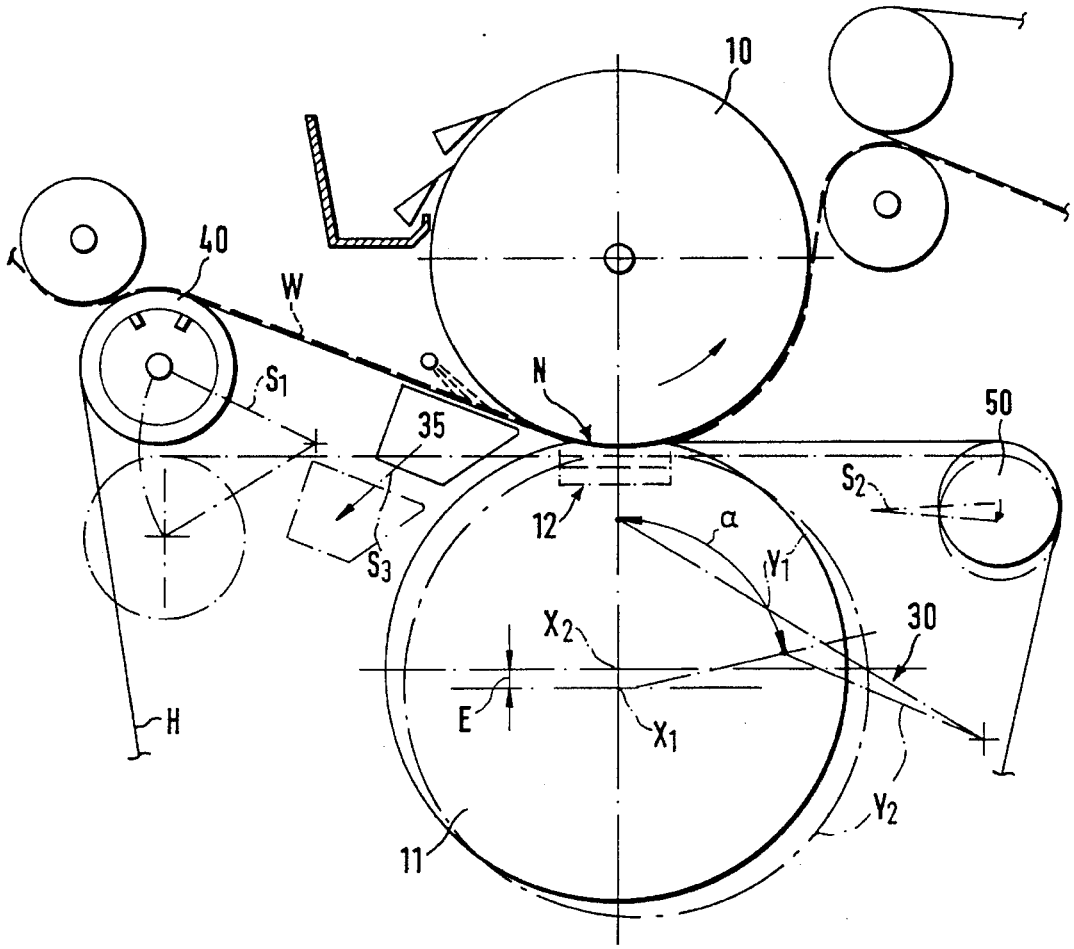
FIG. 4 shows an arrangement in which the method and apparatus of the present invention are applied and in which the position of felt guide rolls and blow boxes can be displaced so that the felt can be separated from the heated upper back-up roll.

FIG. 4 illustrates an arrangement in which the method and apparatus in accordance with the invention are utilized. In this arrangement, when opening the nip N, the felt H can also be moved apart from the heated back-up roll 10. Separation of the felt H from the back-up roll 10 is necessary especially in extended-nip constructions in which the back-up roll 10 is expressly a heated roll. As shown in FIG. 4, a blow box 35 and felt-guide rolls 40 and 50 are arranged to be displaceable by means of actuators $S_1$, $S_2$ and $S_3$, respectively, into different positions, e.g., downwards as shown in FIG. 4. The felt H can then be separated from the back-up roll 10 (FIG. 4 illustrates the actuators), i.e., removed from the nip away from the back-up roll.

As shown in FIG. 4, an angle of rotation of about 45° of the end-flange part 20*b* is sufficient to separate the glide-belt flange from the outer face 10' of the heated roll mantle 10. The actuator 30 is preferably a cylinder device. In FIG. 4, two different operating positions of the cylinder device 30 are illustrated with dashed-dotted lines. In position Y', the glide-belt mantle F is in the operating position and placed against the roll 10. In position Y", the end-flange part 20*b* of the end flange 20 has been rotated through the angle α (about 80°), whereby, owing to the eccentricity E of the end-flange part 20*b*, the glide-belt mantle F is shifted apart from the roll 10. This avoids, e.g., thermal damage to the glide-belt mantle and the loading member, i.e., loading shoe, of the extended nip press roll.

For replacement of the press felt H and glide-belt mantle F, the extent of opening of the nip must be about 20 mm to about 60 mm. Generally before rotation of the end-flange part 20*b*, the loading shoe 12*b* is shifted to the open position by acting upon the actuators $12a_1$,$12a_2$..., to relieve the pressure acting to press the actuators against the loading shoe, so that the loading shoe is situated apart from the glide-belt mantle F.

The examples provided above are not meant to be exclusive. Many other variations of the present invention would be obvious to those skilled in the art, and are contemplated to be within the scope of the appended claims.

What is claimed is:

1. A method for opening a nip in an extended-nip press, including an extended-nip press roll and a back-up roll in a nip-forming relationship, said extended-nip press roll having a central axle, a loading shoe loaded toward the nip by loading members arranged on said extended-nip press roll, said extended-nip press roll having a glide-belt mantle passing through said nip in contact with said loading shoe, said method comprising the steps of:

providing said extended-nip press roll with an end flange having an outer end-flange part and an inner end-flange part operatively coupled by bearing means, coupling said glide-belt mantle to said outer end-flange part, said end flange having a central axis about which said inner end-flange part, said outer end-flange part and said glide-belt mantle rotate, said central axis of said end flange being located a distance from a central axis of said central axle of said extended-nip press roll, and rotating said inner end-flange part to cause said glide-belt mantle to be moved away from said back-up roll and out of the nip.

2. The method of claim 1, further comprising the step of dewatering a web passing through the nip by pressing the web against said back-up roll while said glide-belt mantle runs over said loading shoe and conforms to the shape of said back-up roll.

3. The method of claim 1, wherein said inner end-flange part is rotated in a direction parallel to a face of said central axle of said extended-nip press roll.

4. The method of claim 1, further comprising the step of coupling an actuator to said inner end-flange part for rotating said inner end-flange part to cause said glide-belt mantle to be moved away from said backup roll.

5. The method of claim 1, wherein said inner end-flange part is rotated by a cylinder device.

6. The method of claim 1, further comprising the steps of arranging actuators in connection with press guide rolls and a blow box which guide a felt through the nip in proximity to said back-up roll, and shifting said press guide rolls and said blow box by means of said actuators when the nip is open such that the felt is moved away from said back-up roll.

7. The method of claim t wherein said inner end-flange part is rotated relative to said central axle of said extended-nip press roll.

8. In an apparatus for opening an extended nip formed between a back-up roll and an extended-nip press roll, in which loading members are connected to a central axle of the extended-nip press roll and press a loading shoe toward the back-up roll, and in which a felt carries a web through the nip, a glide-belt mantle passing through the nip in contact with the loading shoe, the improvement comprising said extended-nip press roll having an end flange comprising an outer end-flange part to which said glide-belt mantle is attached and an inner end-flange part, said end flange and thus said inner end-flange part having a central axis arranged eccentric with respect to a central axis of said central axle of said extended-nip press roll, bearing means situated between said inner end-flange part and said outer end-flange part for permitting rotation of said inner end-flange part relative to said outer end-flange part, and means for rotating said inner end-flange part to utilize the eccentricity of said inner end-flange part and move said glide-belt mantle relative to said back-up roll.

9. The apparatus of claim 8, wherein said inner end-flange part is rotated relative to said central axle of said extended-nip press roll.

10. The apparatus of claim 8, wherein said rotation means comprise an actuator operatively coupled to said inner end-flange part.

11. The apparatus of claim 10, wherein said actuator is a cylinder device.

12. The apparatus of claim 8, wherein said inner end-flange part glides along a face of a lateral portion of said central axle of said extended-nip press roll when said inner end-flange part is rotated.

13. The apparatus of claim 8, further comprising displacement means for moving the felt away from said back-up roll, said displacement means comprising displaceable felt-guide rolls arranged on both sides of the nip, a displaceable blow-box, and actuators coupled to said felt-guide rolls and said blow box, said actuators moving said felt-guide rolls and said blow-box into position in which the felt is moved away from said back-up roll.

14. The apparatus of claim 8, wherein said back-up roll is a heated roll.

15. The apparatus of claim 8, wherein said central axle of said extended-nip press roll has a central axial portion on which said loading members are positioned, and a lateral axial portion on which said end flange is positioned, said central axle further comprising a flange arranged between said central axial portion and said lateral axial portion.

16. The apparatus of claim 15, further comprising tensioning means for tensioning said glide-belt mantle, said tensioning means comprising at least one actuator having a first end arranged on said flange of said central axle and a second end opposite to said first end arranged in connection with said inner end-flange part, said inner end-flange part having a groove therein in which said second end of said at least one actuator glides.

17. The apparatus of claim 8, further comprising fastening-ring segments arranged on said outer end-flange part, said fastening-ring segments and said outer end-flange part defining a groove, an end of said glide-belt mantle being arranged in said groove, the apparatus further comprising wedge-ring segments for securing said glide-belt mantle in said groove.

18. A nip having an opening arrangement, comprising a back-up roll, an extended nip press roll arranged adjacent to said backup roll to form a press nip, said press roll having a central axle having a central axis, said press roll having an end flange comprising an outer end-flange part and an inner end-flange part, said end flange and thus said inner end-flange part having a central axis arranged eccentric with respect to said central axis of said central axle of said press roll, loading members connected to said central axle of said press roll, a loading shoe arranged to be pressed by said loading members in a direction toward said back-up roll, a glide-belt mantle attached to said outer end-flange part, bearing means situated between said inner end-flange part and said outer end-flange part for permitting rotation of said inner end-flange part relative to said outer end-flange part, and means for rotating said inner end-flange part to utilize the eccentricity of said inner end-flange part and move said glide-belt mantle relative to said back-up roll.

19. The nip of claim 18, further comprising a felt for carrying a web through the nip, and displacement means for moving the felt away from said back-up roll when the nip is being opened, said displacement means comprising displaceable felt-guide rolls arranged on both sides of the nip, a displaceable blow-box, and actuators coupled to said felt-guide rolls and said blow box, said actuators moving said felt-guide rolls and said blow-box into position in which the felt is moved away from said back-up roll.

* * * * *